United States Patent [19]

Anson et al.

[11] 4,085,701

[45] Apr. 25, 1978

[54] APPARATUS FOR WAX IMPREGNATION

[75] Inventors: George Anson, Armadale; John Liberts, Clayton, both of Australia

[73] Assignee: Andax Pty. Ltd., Australia

[21] Appl. No.: 525,358

[22] Filed: Nov. 20, 1974

[30] Foreign Application Priority Data

Feb. 28, 1974 Australia ..... PB6766

[51] Int. Cl.[2] ..... B05C 5/00; B05C 7/02; B05C 13/02

[52] U.S. Cl. ..... 118/57; 118/63; 118/324; 118/DIG. 4

[58] Field of Search ..... 118/57, DIG. 4, 324, 118/325, 24, 603, 610, 63; 427/420, 346, 347

[56] References Cited

U.S. PATENT DOCUMENTS

| | | | |
|---|---|---|---|
| 2,060,897 | 11/1936 | Richardson et al. | 118/DIG. 4 |
| 2,073,576 | 3/1937 | Climenhaga | 118/57 X |
| 2,745,419 | 5/1956 | Slingerland | 118/DIG. 4 |
| 2,884,898 | 5/1959 | Peterson | 118/DIG. 4 |
| 3,219,012 | 11/1965 | Stream | 118/DIG. 4 |
| 3,635,193 | 1/1972 | Stease | 118/324 X |
| 3,695,219 | 10/1972 | Arian et al. | 118/DIG. 4 |
| 3,717,121 | 2/1973 | Bruckbauer et al. | 118/DIG. 4 |

FOREIGN PATENT DOCUMENTS

| | | | |
|---|---|---|---|
| 1,086,301 | 10/1967 | United Kingdom | 118/DIG. 4 |

*Primary Examiner*—John P. McIntosh

*Attorney, Agent, or Firm*—Silverman, Cass & Singer, Ltd.

[57] ABSTRACT

Method and apparatus for applying wax to a cardboard box blank formed from board having substantially straight parallel open-ended internal interstices, in which a zone of cascading flow of wax impregnated material is generated and the box blank is passed through the zone with the board interstices open to the wax flow.

7 Claims, 9 Drawing Figures

APPARATUS FOR WAX IMPREGNATION

BACKGROUND OF THE INVENTION (i) Field of the Invention

This invention relates to a method and apparatus for applying liquid settable material to board products and particularly, but not exclusively, is concerned with impregnation of corrugated cardboard products with wax.

(ii) Prior Art

Corrugated cardboard boxes intended for certain uses are customarily impregnated with wax to increase the strength of the boxes and to give some measure of water resistance. When impregnation of this kind is effected it is desirable that the wax should impregnate not only outer surfaces of the box but also the surfaces of the inner layer of corrugated board material. The boxes may be impregnated in their partly assembled condition, that is when the box blanks have been glued but not erected or they may be impregnated by first impregnating the board from which the box blanks are to be formed. In the latter case difficulties may be experienced in forming secure joints between parts of the box blanks because the waxed board does not take adhesive as well as unwaxed board. This difficulty can usually be overcome by the use of special glues but this may not always be practicable and is generally inconvenient and relatively expensive. The difficulty can also be avoided to some extent by impregnating the board by a known method involving passing the wax only between the outer board layers and down the tubular interstices in the board provided between the outer layers and the inner corrugated layer so that the interior surfaces of the corrugated board are impregnated but not the outer surfaces. This does, however, require very careful control of the impregnating operation since seepage of wax to the outer surfaces of the board can occur. Furthermore, this method is not suitable for relatively thin material where it will normally be impossible to prevent seepage to the outer surfaces no matter how careful the control be of the impregnating process.

If the blanks for the boxes are impregnated after formation of glued joints the above difficulties do not, of course, arise. However, impregnation of glued but not erected blanks has been found to be difficult because of the relatively complex shape of the blanks in this condition. It has been found difficult to thoroughly impregnate the inner parts of the blank material and even where good impregnation has occurred there is a tendency for the wax to coalesce in the ducts formed by the board interstices thus causing waste of wax and also frequently presently an unattractive appearance.

BRIEF SUMMARY OF THE INVENTION

According to the present invention there is provided apparatus for applying liquid settable material to a board product formed from board having substantially straight parallel open-ended internal interstices, comprising flow means for generating a zone of cascading flow of said material and movement means for passing the board product transversely through said zone with said interstices open to and aligned with said flow.

The invention also provides a method for applying liquid settable material to a board product formed from board having substantially straight parallel open-ended internal interstices, comprising the steps of generating a zone of a cascading flow of said material and passing said product through said zone with said interstices open to and aligned with said flow.

Normally said flow is downward and the board product is passed horizontally through the flow.

The board product may be moved through the flow on a conveyor.

Excess settable material may be removed from said interstices after passage of said board product through said cascading flow by subjecting the product to jolting movements.

Alternatively, it may be removed by subjecting the product at least to downwardly directed airflow.

The process may be carried out in a tunnel which provides a heated environment.

BRIEF DESCRIPTION OF THE SEVERAL VIEWS OF THE ACCOMPANYING DRAWINGS

The invention is further described with reference to the accompanying drawings in which.

DETAILED DESCRIPTION

Figure 1:
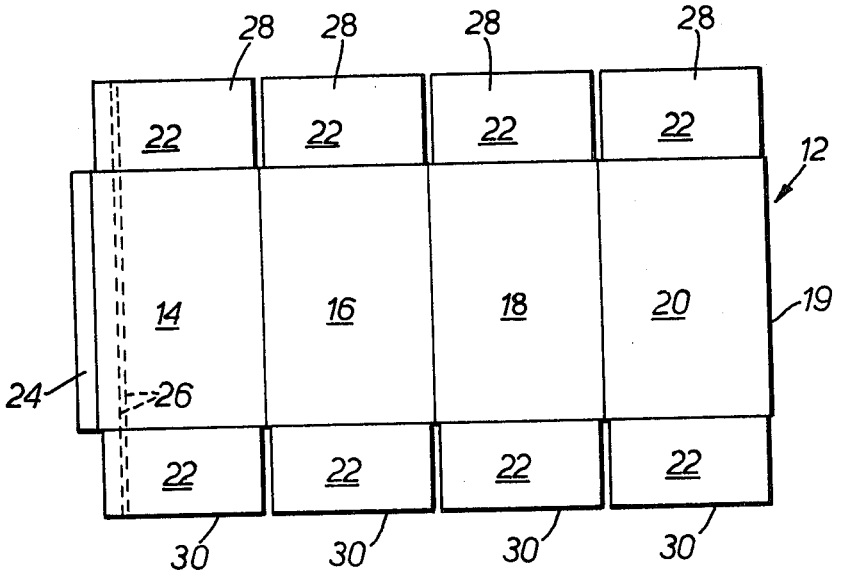
FIG. 1 is a plan view of a blank for forming a cardboard box.
Figure 2:
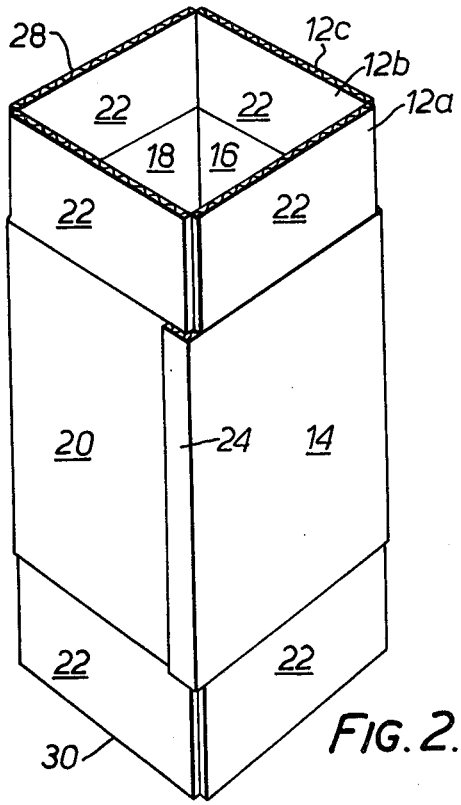
FIG 2 is a perspective view of the blank of FIG. 1 glued and ready for erection.
Figure 3:
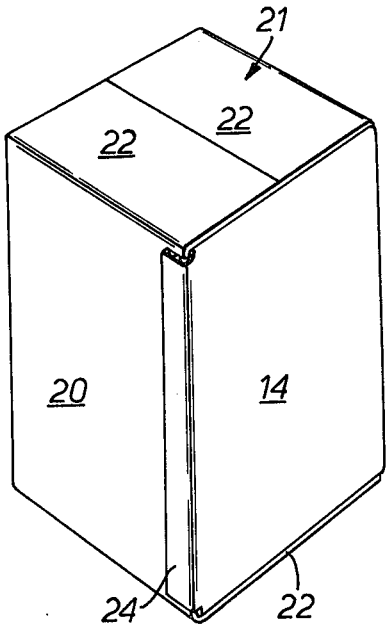
FIG. 3 is a perspective view of a box formed by erecting the glued blank of FIG. 2.

FIGS. 1 to 3 illustrate steps in the formation of a cardboard box of a kind which can be treated in the apparatus of the invention. The box is formed from a blank 12 having four rectangular panels 14, 16, 18 and 20 which are in end-to-end alignment, each panel 14, 16, 18 and 20 having a pair of side panels 22 one to each side thereof. Panels 22 are also rectangular. Panel 14 is additionally formed with a transverse edge flap 24. The blank 12 is cut from a single piece of corrugated cardboard of the usual type having a pair of spaced parallel cardboard outer sheets **12*a*, 12*b* and a corrugated inner sheet 12*c* secured to inner faces of the outer sheets. The corrugations of the inner sheet run transversely of the blank 12 as indicated by broken lines 26 so that interstices between the inner sheet and outer sheets likewise extend continuously and transversely across the whole width of blank 12. Blank 12 is, after formation, partially assembled by gluing or stitching flap 24 to a free transverse edge 19 of panel 20 as shown in FIG. 2. In a final assembly operation the blank is formed into a cuboidal box by inwardly folding panels 22 in overlapping configuration to form top and bottom walls of the box, only top wall 21 being visible in the drawings. Panels 14, 16, 18 and 20 then form side walls of the box. It will be noted that in the condition shown in FIG. 2, the interstices of the corrugated cardboard run in uninterrupted fashion from opposed edges 28 and 30** of the blank.

Figure 4:
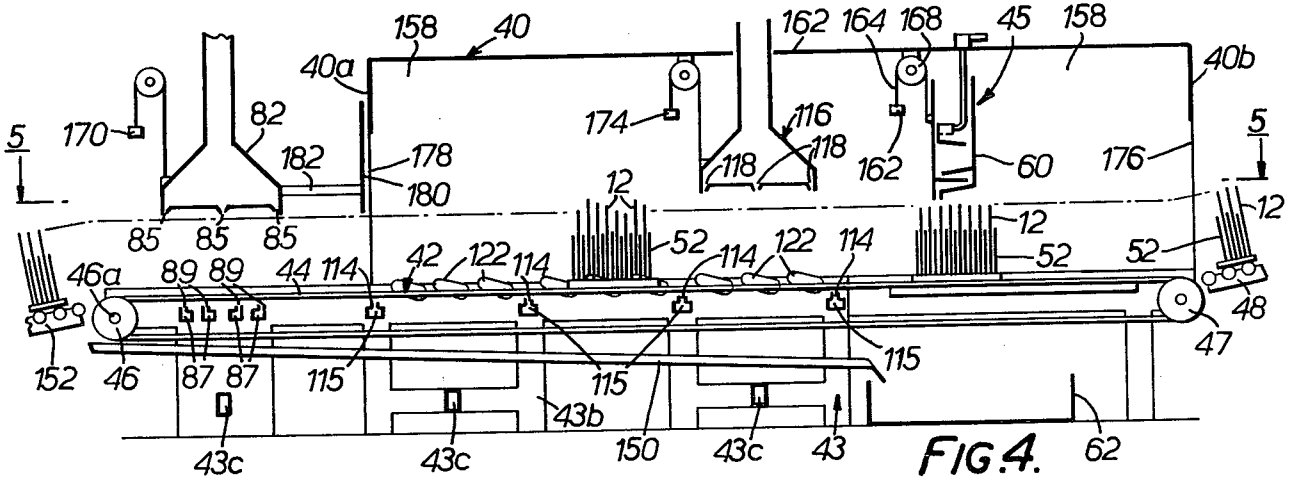
FIG. 4 is a side view of apparatus constructed in accordance with the invention, with part thereof shown in vertical section.
Figure 5:
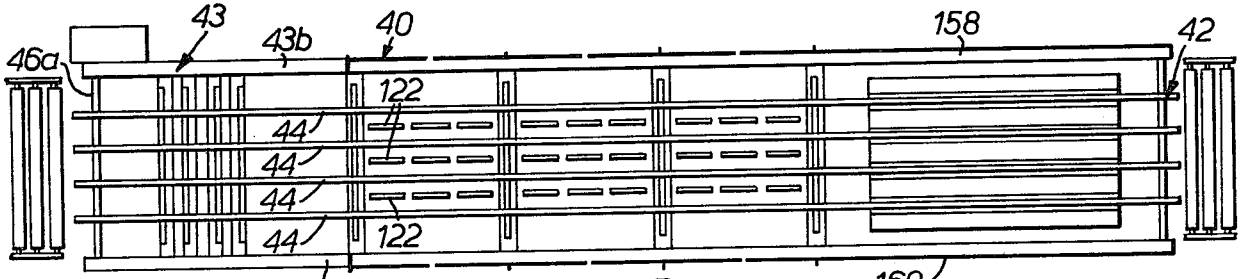
FIG. 5 is a cross-section on the line 5—5 in FIG. 4.
Figure 7:
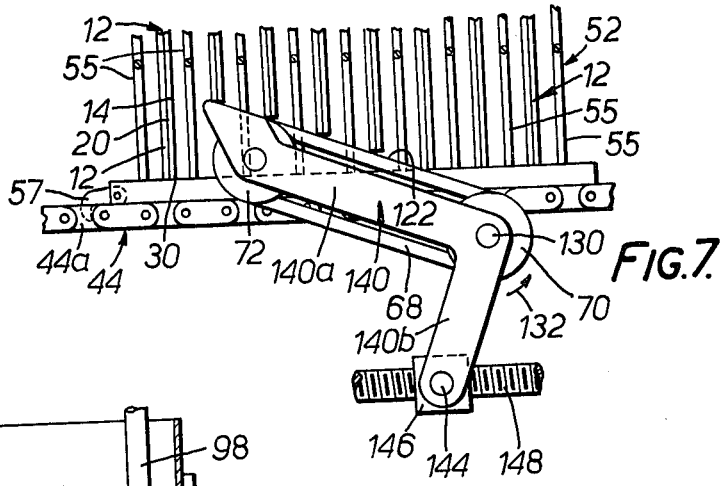
FIG. 7 is a fragmentary side view of part of a jolting mechanism incorporated in the apparatus of FIGS. 4 and 5.
Figure 8:
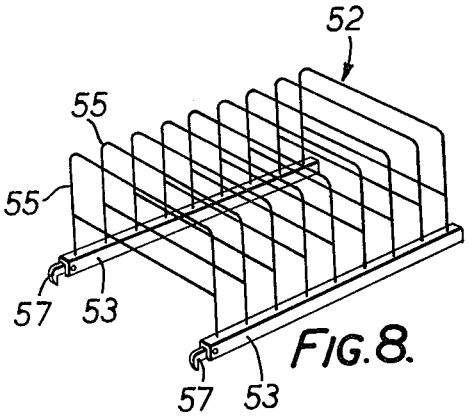
FIG. 8 is a perspective view of a cage for holding box blanks to be passed through the apparatus of FIGS. 4 and 5 and FIG. 9 is a fragmentary side sectional view of a modification of the apparatus of FIGS. 4 and 5.

The apparatus shown in FIGS. 4 and 5 includes a horizontal tunnel 40 through which runs a horizontal conveyor 42. Conveyor 42 includes four side-by-side endless chains 44 running over end sprockets 46, 47, there being one sprocket 46 and one sprocket 47 for each chain. Sprockets 46 are carried by a single horizontal shaft 46*a* located at an outlet end 40*a* of tunnel 40, whilst sprockets 47 are carried by a single shaft 47*a*, at an inlet end 40*b* of tunnel 40. Shaft 46*a* and 47*a*, together with tunnel 40, are supported from a bed 43 of the apparatus. Box blanks 12 to be treated in the apparatus are supplied in sequence to the inlet end 40*b* of tunnel 40 and fed onto conveyor 41 from a delivery conveyor 48, a number of box blanks 12 being provided in each of a number of wire cages 52 which are thus passed sequentially through tunnel 40 on conveyor 42. Cages 52 are each of the form shown in FIG. 8, having a pair of longitudinally extending spaced parallel base bars 53 interconnected by upper upright wire frames 55, there being a number of these frames which extend transversely of the cage. Frames 55 are equi-spaced from each other in the longitudinal direction of the cage along the lengths of the bars 53. Bars 53 are spaced so as to rest in longitudinally extending disposition upon outermost ones of the chains 44 and forward ends thereof carry downwardly depending hooks 57 which engage spaces within links 44*a* of outer ones of the chains 44 as shown in FIG. 7 to enable the chains to impart movement to a cage. As best seen in FIG. 7, blanks 12 are positioned between adjacent pairs of frames 55 on a cage 52. The blanks are processed when they are at a stage where they are assembled in a manner shown in FIG. 2, but collapsed to a nearly planar state by inward folding of panels 14, 16, 18 and 20 so that panels 14 overlie panels 16 and panels 20 overlie panels 18. The blanks are positioned with lower edges 30 resting on bars 53 so that the blanks extend transversely of the cage, and thus of tunnel 40, with the corrugations of the board from which the blanks are formed extending vertically.

As the blanks 12 pass into the inlet end of the tunnel 40, they are subjected, at an impregnation station 45, to a cascade of molten wax which overflows from a head weir 60. Head weir 60 is so disposed as to cause wax to enter and run through the interstices of the board comprising the blanks and to completely cover the external and internal surfaces of the blanks. Excess wax falls to a receptacle 62 at the bottom of the tunnel and is led away for recirculation back to weir 60 via a pumping system (not shown).

Figure 6:
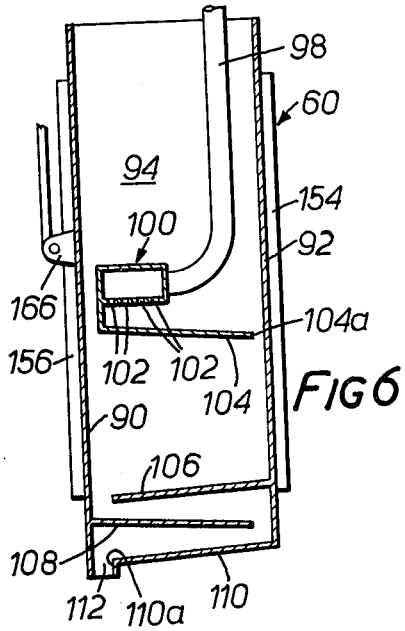
FIG. 6 is a fragmentary vertical cross-section of a weir incorporated in the apparatus of FIGS. 4 and 5.

As best shown in FIG. 6 weir 60 is in the form of a receptacle which extends transversely of tunnel 40. It includes spaced upright transverse walls 90, 92 which are interconnected by longitudinal upright end walls only one of which end walls is visible in the drawings, being denoted by reference numeral 94. Liquid wax is admitted to the weir via a pipe 98 which extends into the weir from the open upper side thereof to communicate with a transverse distribution duct 100 which is located between the end walls of the weir and which has a series of outlet openings 102 distributed over substantially the whole of the area of a lower wall 102*a* of the duct 100. A baffle plate 104 extends transversely of the weir and is located between plates 90, 92. It is positioned immediately below openings 102 and slopes downwardly and away therefrom so that wax issuing from openings 102 falls evenly thereon and thence downwardly over the upper surface thereof to pass over a free edge 104*a* of plate 104. Edge 104*a* is located close to and parallel to wall 92. Wax so flowing over edge 104*a* then passes downwardly in a tortuous path over a series of vertically spaced sloping transverse baffles 106, 108 and 110 which extend alternatingly from walls 90 and 92 and which have alternatingly disposed downwardly directed slopes, each baffle 106, 108, 110 terminating at a free transverse edge thereof adjacent to but spaced from the walls 90, 92 opposite to the wall from which it extends. The lowermost of these baffles, baffle 110, forms a lower wall of the weir and wax issues from the weir via a transverse slot-like opening 112 formed between wall 90 and the free edge 110*a* of baffle 110.

After impregnation with wax, the blanks are carried further along tunnel 40 on conveyor 42 where they are subjected to a heated environment maintained within the tunnel and produced by passing heated air into the tunnel via upwardly directed openings 114 in transverse ducts 115 at the lower part of the tunnel and via downwardly directed openings 118 in an upper transverse duct 116 in tunnel 40. This heated environment maintains the impregnated wax in a molten condition.

Bed 43 is formed by two upright side frames 43*a*, 43*b* interconnected by transverse members 43*c* and these are formed from hollow metal sections having communicating interiors. The bed carries hot plate sections (not shown) through which heated oil is circulated. This maintains the bed 43 in a heated condition thus preventing setting of wax on the chains 44 and also heating the interior of tunnel 40. The tunnel has openable doors (not shown) on each side and, when opened, create quicker cooling conditions in the tunnel because of the cooler atmospheric air then admitted.

During progression of the blanks through the tunnel 40 after leaving impregnation station 45, the blanks are subjected to periodic vertical jolting movements in order to dislodge excess molten wax from the panels, particularly from the interstices of the board from which the blanks are formed. This movement is effected by passage of the blanks 12 over inclined ramps 122 (FIGS. 4 and 5). As shown in FIG. 7, these ramps are defined by upper runs of small endless chains 68. There are a number of transverse rows of chains 68 providing corresponding transverse rows of ramps 122. Each row consists of three ramps, one ramp of each row being positioned between each adjacent pair of chains 44. The chain 68 forming each ramp 122 runs about a separate lower end sprocket 70 and about a separate upper end sprocket 72, each sprocket 72 being spaced further towards the outlet end 40*a* of the tunnel 40 than the associated sprocket 70 and being at a somewhat higher location. The dispositions of the chains 68 is such that although the lower edges 30 of the box blanks 12 engage these as they pass along the tunnel 40, the cages holding the box blanks are not so engaged, frames 55 being located such as to give a clearance above the upper end of the ramps. The cages thus continue in a straight horizontal line of movement as they pass over the ramps.

The sprockets 70 associated with each row of chains 68 are carried by a single shaft 130. In the present instance there are nine rows of chains 68 and there are thus nine shafts 130, these each being mouned for free rotation and extending transversely of the bed 43, being carried in bearings (not shown) on the bed. A motor (not shown) is coupled to drive each of the shafts 130 via a chain in the direction indicated by arrow 132 in FIG. 7 at speeds such that the box blanks 12 and cages 52 travelling on conveyor 42 are maintained moving at a substantially constant speed as the cages pass over chains 68. Thus, as each cage passes over the ramps 122 defined by the upper runs of a row of chains 68, the box blanks therein are progressively lifted as shown in FIG. 7 and subsequently dropped as the cage passes over the rear ends of that row of ramps. It has been found that the resultant jolting movement which occurs when the box blanks are returned and engage the base bars 53 of the cage carrying them after passing over the rear ends of the row of ramps is particularly effective in removing excess molten wax.

The sprockets 70, 72 associated with each chain 68 are carried by an L-shaped bracket 140, the shaft 130 of each row passing through openings in the brackets 140 carrying chains 68 in that row. The openings are adjacent the junction of two arms 140*a*, 140*b* of the brackets. Sprockets 72 are carried by axles received in openings at free ends of the arms 140*a* of brackets 140, the latter arms extending rearwardly upwardly at an inclined disposition from the associated axle 130. The arms 140*b* in each row extend downwardly and rearwardly from the associated shaft 130 to free ends which have apertures therein. These apertures receive pivot pins 144 which pivotally couple the brackets to internally apertures and screw threaded nuts 146. Nuts 146 of the brackets 140 of all the belts 68 which are between a single pair of chains 44 are threadedly engaged on a lead screw 148. There are thus three such lead screws each extending lengthwise of the conveyor 42 and mounted on bed 43 by means (not shown) for axial rotation. By turning the lead screws it is possible to adjust the inclination of arms 140*a* of the brackets 140 thus to also vary the inclination of arms 140*a* and the inclination of ramps 122. This variation enables adjustment of the inclination to produce most satisfactory results in operation of the apparatus.

Air issuing from openings 118 in ducts 116, and that issuing from openings 114 in ducts 115 further facilitates removal of the molten wax. This air tends to blow excess material from the surfaces of the blanks.

Excess wax removed by the above process falls to an inclined channel 150 located below conveyor 42 to be returned to receptacle 62.

Blanks passing from the outlet end 40*a* of tunnel 40 pass on conveyor 42 through downwardly and upwardly directed air blasts. The downward air blast is provided by passing air to a shroud 82 over the rear end of the conveyor 42, this having outlet openings 85 through which the air issues. The upwardly directed air blast is provided by applying air to a series of cross ducts 87 having upwardly directed openings 89 through which air issues. This air may be cool air to thereby cool wax on blanks 12 as they emerge from tunnel 40 to facilitate subsequent handling of the blanks.

The described apparatus will operate most efficiently if the clearance between upper edges of the blanks 12 and the lowermost parts of the weir 60, duct 116 and shroud 82 is minimal. Thus, to allow for processing of blanks of differing height, the shroud 82, duct 116 and weir 60 are mounted for variable vertical positioning. Thus, weir 60 is positioned in tunnel 40 and its end walls adjacent and parallel to side walls 158, 160 of tunnel 40. Each side wall 158, 160 has a pair of vertical rails, the rails secured to wall 158 being visible in FIG. 6 and designated by reference numerals 154, 156. Rail 154 is located adjacent the outer surface of the wall 92 of the weir whilst rail 156 is located adjacent the outer surface of the wall 90 of the weir. These rails, and corresponding rails on wall 160 mount the weir for vertical movement. Pulley wheel 168 is mounted from the roof 162 of tunnel 40 and weir 60 is counterweighted by means of counterweight 160 coupled to the weir by means of a cord 164 which passes upwardly from the weight, over pulley wheel 168 and thence downwardly to be secured to a lug 166 on wall 90 of the weir. Weight 162 is selected such that weir 60 can be freely and readily positioned to the desired height over a range of such heights sufficient to accommodate the desired variation in height of panels 12 to be processed. Although the plates 90, 92 and end walls of weir 60, together with the baffles 106, 108, 110 thereof are thus movable vertically duct 100 and baffle plate 104 are not so movable being in fixed disposition to enable pipe 92 to be formed as a rigid unit.

Duct 116 and shroud 82 are each mounted for vertical movement and counterweighted by counterweights 174, 170 respectively. In order to minimize the escape of heated air from tunnel 40 an upright transverse closure plate 180 is secured to shroud 82 by a beam 182 for up and down movement together with shroud 82 and this plate is positioned to variably close an outlet opening 178 from tunnel 40 to vary the effective height of such opening in accordance with the positioning of the shroud 82. Of course, the inlet opening 176 to the tunnel could likewise be provided with a similar closure member.

Cages 52, after passing through the air blasts provided by shroud 82 and ducts 87 pass over the rear end of the conveyor 42 and are carried from the apparatus on a conveyor 152.

Figure 9:
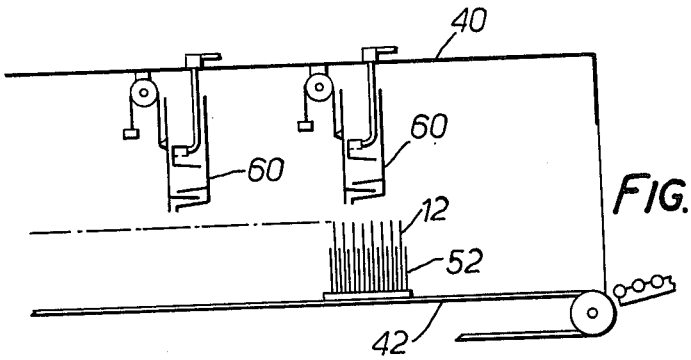

In the modified apparatus shown in FIG. 9, two weirs 60 are provided at the inlet end of tunnel 40. These are arranged to successively coat blanks 12 with two coatings of the same wax or with two different waxes. Thus, a first coating which impregnates the blanks may be provided a second coating being applied over the first coating to give a desired surface coating.

The method and apparatus described provide for ready treatment of blanks in the semi-assembled form as shown in FIG. 2. At this stage of the manufacture of the box all printing and gluing of the blank can easily be arranged to have been completed. Thus, one might print directly onto the blank, when in the condition shown in FIG. 1, any desired advertising or other display material and the gluing of the box is here already completed before final erection. Of course, many modifications may be made to the described method and apparatus. Particularly, the blanks could be treated in the apparatus singularly rather than in batches in the cages 52. Although the final cooling operation is advantageous, this can be omitted if desired. The method is also applicable to treatment of single sheets of corrugated board or of other material and to treatment of partially completed box of different configurations to that shown. Again, whilst the described jolting of blanks to remove excess wax has been found to be particularly satisfactory, it is possible to provide adequate excess wax removal in many instances only by use of upwardly and downwardly directed air blasts as provided by issuance of air from ducts 116 and ducts 115. Whilst the blanks are, in the described apparatus, passed through the apparatus with major planes of the blanks normal to the direction of movement, they could of course be passed through with the major planes longitudinally disposed, or at any desired intermediate disposition.

These and many other modifications may be made to the described construction without departing from the spirit and scope of the invention as defined in the appended claims.

We claim:

1. Apparatus for applying liquid settable material to a board product formed from board having substantially straight parallel open-ended internal interstices, said apparatus comprising, flow means for generating a zone of cascading flow of said material and generally horizontal conveyor means for passing the board product thereon through said zone with said interstices in a substantially vertical position and open to said flow, clearance means for clearing excess liquid settable material from said interstices after the board product has passed through said flow means, said clearance means including an inclined ramp adjacent said conveyor means over which said product is caused to move as it is carried by said conveyor means, said ramp being upwardly inclined in the direction of travel and having an upper end, whereby the board product is subjected to jolting pursuant to termination of downward movement of the board product after it passes over the upper end of the ramp.

2. Apparatus for applying liquid settable material to a board product formed from board having substantially straight parallel open-ended internal interstices, said apparatus comprising, flow means for generating a zone of cascading flow of said material and generally horizontal conveyor means for passing board product thereon through said zone with said interstices in a substantially vertical position and open to said flow, clearance means for clearing excess liquid settable material from said interstices after the board product has passed through said flow means, said clearance means including an inclined ramp adjacent said conveyor means over which said product is caused to move as it is carried by said conveyor means, said ramp being upwardly inclined in the direction of travel and having an upper end, whereby the board product is subjected to jolting pursuant to termination of downward movement of the board product after it passes over the upper end of the ramp, support means for supporting said board product in upright disposition on said conveyor such that a lower edge of the board product is supported at opposed sides thereof located at corresponding sides of said conveyor, said ramp being positioned between said sides of the conveyor whereby, as the board product passes over said ramp, said lower edge is engaged by said ramp and lifted.

3. Apparatus as claimed in claim 2 wherein said support means is in the form of a cage adapted to retain a plurality of like ones of said board product so that each is liftable separately by engagement with said ramp as the support member passes thereover.

4. Apparatus as claimed in claim 3 wherein said ramp is in the form of an endless conveyor loop presenting an inclined upper run thereof extending between end wheels around which the loop runs, and means for driving said upper run of said loop in the same direction as the direction of movement of said board product past the ramp and at such a rate as to maintain the board product moving at a substantially constant forward rate relative to the conveyor as the board product passes over and engages said ramp.

5. Apparatus as claimed in claim 4 wherein said ramp is so positioned relative to the conveyor that the said cage is not lifted as the cage passes thereover.

6. Apparatus as claimed in claim 5 wherein said wheels are supported by a bracket pivoted about a drive shaft for one of the wheels, which drive shaft extends transversely of said conveyor, and said bracket having two arms one of which extends from said drive shaft to a free end at which the other of said wheels is supported for free rotation and the other of which arm extends to a free end which carries a nut, pivotally mounted on said other arm and threadedly engaged on a threaded shaft extending lengthwise of the conveyor whereby the incline of the ramp can be altered by turning said threaded shaft to move the nut along the threaded shaft thereby moving the free end of said other arm to pivot the bracket about said drive shaft.

7. Apparatus as claimed in claim 6 wherein said conveyor is formed by two endless side by side but spaced chains, with said ramp being located therebetween, and said cage has two side by side spaced lengthwise extending base bars adapted to rest on respective ones of the chains, and having respective forward downwardly extending projections adapted to be received in links of the respective chains to removably key the cage to the chains for movement therewith, said cage further including a plurality of open upright transverse frames interconnecting said base bars and between which a plurality of said board products can be positioned for supporting these in upright transverse disposition resting on the base bars, said frames being of height sufficient to clear said ramp during movement of the cage on said conveyor.

* * * * *